US008397327B2

(12) United States Patent
O'Reagan

(10) Patent No.: US 8,397,327 B2
(45) Date of Patent: Mar. 19, 2013

(54) BED INSERT

(75) Inventor: James R. O'Reagan, Greer, SC (US)

(73) Assignee: Span-America Medical Systems, Inc., Greenville, SC (US)

( * ) Notice: Subject to any disclaimer, the term of this patent is extended or adjusted under 35 U.S.C. 154(b) by 10 days.

(21) Appl. No.: 13/218,612

(22) Filed: Aug. 26, 2011

(65) Prior Publication Data

US 2012/0047651 A1 Mar. 1, 2012

Related U.S. Application Data

(60) Provisional application No. 61/378,507, filed on Aug. 31, 2010.

(51) Int. Cl.
*A47C 27/14* (2006.01)
*A61G 7/057* (2006.01)

(52) U.S. Cl. ..... 5/739; 5/400; 5/722; 5/727

(58) Field of Classification Search ..... 5/400, 401, 5/411, 412, 705, 717, 722, 727, 732, 739, 5/426, 427, 690, 691, 661, 185, 663, 692
See application file for complete search history.

(56) References Cited

U.S. PATENT DOCUMENTS

| | | | | |
|---|---|---|---|---|
| 3,644,950 | A | 2/1972 | Lindsay, Jr. | |
| 3,846,857 | A | 11/1974 | Weinstock | |
| 4,522,447 | A | 6/1985 | Snyder et al. | |
| 4,639,952 | A | 2/1987 | Kensinger | |
| 4,706,313 | A | 11/1987 | Murphy | |
| 4,753,480 | A | 6/1988 | Morell | |
| 4,754,509 | A | 7/1988 | Pollard | |
| 4,759,088 | A * | 7/1988 | Brown | 5/401 |
| 4,783,864 | A | 11/1988 | Turner | |
| 4,951,334 | A | 8/1990 | Maier | |
| 5,010,611 | A | 4/1991 | Mallett | |
| 5,107,558 | A | 4/1992 | Lück | |
| 5,117,521 | A | 6/1992 | Foster et al. | |
| 5,231,717 | A | 8/1993 | Scott et al. | |
| 5,335,651 | A | 8/1994 | Foster et al. | |
| 5,337,845 | A | 8/1994 | Foster et al. | |
| 5,370,111 | A | 12/1994 | Reeder et al. | |
| 5,430,901 | A | 7/1995 | Farley | |
| 5,454,126 | A | 10/1995 | Foster et al. | |
| 5,457,831 | A | 10/1995 | Foster et al. | |
| 5,479,666 | A | 1/1996 | Foster et al. | |
| 5,483,709 | A | 1/1996 | Foster et al. | |
| 5,497,766 | A | 3/1996 | Foster et al. | |
| 5,513,402 | A | 5/1996 | Schwartz | |
| 5,513,406 | A | 5/1996 | Foster et al. | |
| 5,562,091 | A | 10/1996 | Foster et al. | |
| 5,577,279 | A | 11/1996 | Foster et al. | |
| 5,630,238 | A | 5/1997 | Weismiller et al. | |
| 5,649,331 | A | 7/1997 | Wilkinson et al. | |

(Continued)

FOREIGN PATENT DOCUMENTS

EP 0 558 108 A2 9/1993

*Primary Examiner* — Michael Trettel
(74) *Attorney, Agent, or Firm* — Dority & Manning, P.A.

(57) ABSTRACT

An insert for a bed facilitates use of a mattress having one cross-sectional profile with a bed frame having a different cross-sectional profile. An insert includes a base extending between sidewalls which have various contoured surfaces. The contoured sidewall surfaces enable the insert to be disposed in a bed frame in association with a mattress. Inner surfaces of the sidewalls are configured to accommodate receipt of a mattress while outer surfaces of the sidewalls are configured for the insert to be disposed in a bed frame. The surface sidewalls may further be configured to provide the insert with a safety feature which prevents or reduces the likelihood of a user falling from the side of a mattress associated with the insert.

21 Claims, 3 Drawing Sheets

U.S. PATENT DOCUMENTS 5,652,985 A 8/1997 Wilkinson et al.
5,666,681 A 9/1997 Meyer et al.
5,672,849 A 9/1997 Foster et al.
5,680,661 A 10/1997 Foster et al.
5,682,631 A 11/1997 Weismiller et al.
5,692,256 A 12/1997 Kramer et al.
5,708,997 A 1/1998 Foster et al.
5,715,548 A 2/1998 Weismiller et al.
5,724,685 A 3/1998 Weismiller et al.
5,745,937 A 5/1998 Weismiller et al.
5,781,949 A 7/1998 Weismiller et al.
5,797,155 A 8/1998 Maier et al.
5,822,817 A 10/1998 Carew et al.
5,855,415 A 1/1999 Lilley, Jr.
5,933,888 A 8/1999 Foster et al.
5,940,910 A 8/1999 Weismiller et al.
5,987,666 A 11/1999 Zigmont
6,036,271 A 3/2000 Wilkinson et al.
6,047,424 A 4/2000 Osborne et al.
6,112,345 A 9/2000 Foster et al.
6,119,291 A 9/2000 Osborne et al.
6,151,739 A 11/2000 Meyer et al.
6,163,903 A 12/2000 Weismiller et al.
6,182,310 B1 2/2001 Weismiller et al.
6,212,714 B1 4/2001 Allen et al.
6,223,369 B1 5/2001 Maier et al.
6,223,370 B1 5/2001 Kluft
6,269,504 B1 8/2001 Romano et al.
6,336,235 B1 1/2002 Ruehl
6,374,436 B1 4/2002 Foster et al.
6,427,264 B1 8/2002 Metz et al.
6,430,763 B2 8/2002 Kosumsuppamala et al.
6,496,993 B2 12/2002 Allen et al.
6,499,167 B1 12/2002 Ellis et al.
6,510,571 B1 * 1/2003 Tittle et al. ..... 5/400
6,519,798 B2 * 2/2003 Gladney et al. ..... 5/690
6,584,628 B1 7/2003 Kummer et al.
6,601,253 B1 8/2003 Tarquinio
6,611,979 B2 9/2003 Welling et al.
6,658,680 B2 12/2003 Osborne et al.
6,684,427 B2 2/2004 Allen et al.
6,691,346 B2 2/2004 Osborne et al.
6,694,548 B2 2/2004 Foster et al.
6,701,556 B2 3/2004 Romano et al.
6,704,954 B2 3/2004 Metz et al.
6,725,474 B2 4/2004 Foster et al.
6,779,209 B2 8/2004 Ganance
6,782,574 B2 8/2004 Totton et al.
6,848,130 B1 2/2005 Wilson
6,880,189 B2 4/2005 Welling et al.
6,957,461 B2 10/2005 Osborne et al.
6,978,500 B2 12/2005 Osborne et al.
6,993,799 B2 2/2006 Foster et al.
7,000,272 B2 2/2006 Allen et al.
7,017,208 B2 3/2006 Weismiller et al.
7,073,220 B2 7/2006 Simmonds et al.
7,076,818 B2 7/2006 Kummer et al.
7,086,107 B2 * 8/2006 Ellis et al. ..... 5/722
7,100,222 B2 9/2006 Metz et al.
7,103,933 B2 * 9/2006 Gladney et al. ..... 5/690
7,107,636 B2 9/2006 Metz et al.
7,171,708 B2 2/2007 Osborne et al.
7,191,480 B2 3/2007 Romano et al.
7,191,482 B2 3/2007 Romano et al.
7,213,279 B2 5/2007 Weismiller et al.
7,216,384 B2 5/2007 Allen et al.
7,216,389 B2 5/2007 Ellis et al.
7,237,287 B2 7/2007 Weismiller et al.
7,274,305 B1 9/2007 Luttrell
7,293,305 B2 11/2007 Metz et al.
7,296,312 B2 11/2007 Menkedick et al.
7,296,315 B2 11/2007 Totton et al.
7,353,557 B2 4/2008 Ellis et al.
7,360,265 B2 4/2008 Lamer
7,406,731 B2 8/2008 Menkedick et al.
7,451,506 B2 11/2008 Kummer et al.
7,454,805 B2 11/2008 Osborne et al.
7,480,951 B2 1/2009 Weismiller et al.
7,480,953 B2 1/2009 Romano et al.
7,506,390 B2 3/2009 Dixon et al.
7,520,006 B2 4/2009 Menkedick et al.
7,523,515 B2 4/2009 Allen et al.
7,533,429 B2 5/2009 Menkedick et al.
7,568,246 B2 8/2009 Weismiller et al.
7,610,637 B2 11/2009 Menkedick et al.
7,617,555 B2 11/2009 Romano et al.
7,644,458 B2 1/2010 Foster et al.
7,669,263 B2 3/2010 Menkedick et al.
7,703,158 B2 4/2010 Wilker, Jr. et al.
7,779,496 B2 * 8/2010 Crousore et al. ..... 5/710
7,784,128 B2 8/2010 Kramer
7,802,332 B2 9/2010 Kummer et al.
7,904,979 B2 3/2011 Walke et al.
7,926,131 B2 4/2011 Menkedick et al.
7,966,680 B2 6/2011 Romano et al.
8,056,165 B2 11/2011 Kummer et al.
8,065,764 B2 11/2011 Kramer
2005/0000026 A1 * 1/2005 Gladney ..... 5/717
2006/0282955 A1 12/2006 Gilchrest, Jr. et al.
2009/0188048 A1 7/2009 Shlomo
2010/0306921 A1 12/2010 Kramer
2010/0306924 A1 12/2010 Kummer et al.
2011/0289685 A1 12/2011 Romano et al.
2012/0054965 A1 3/2012 Kummer et al.

* cited by examiner

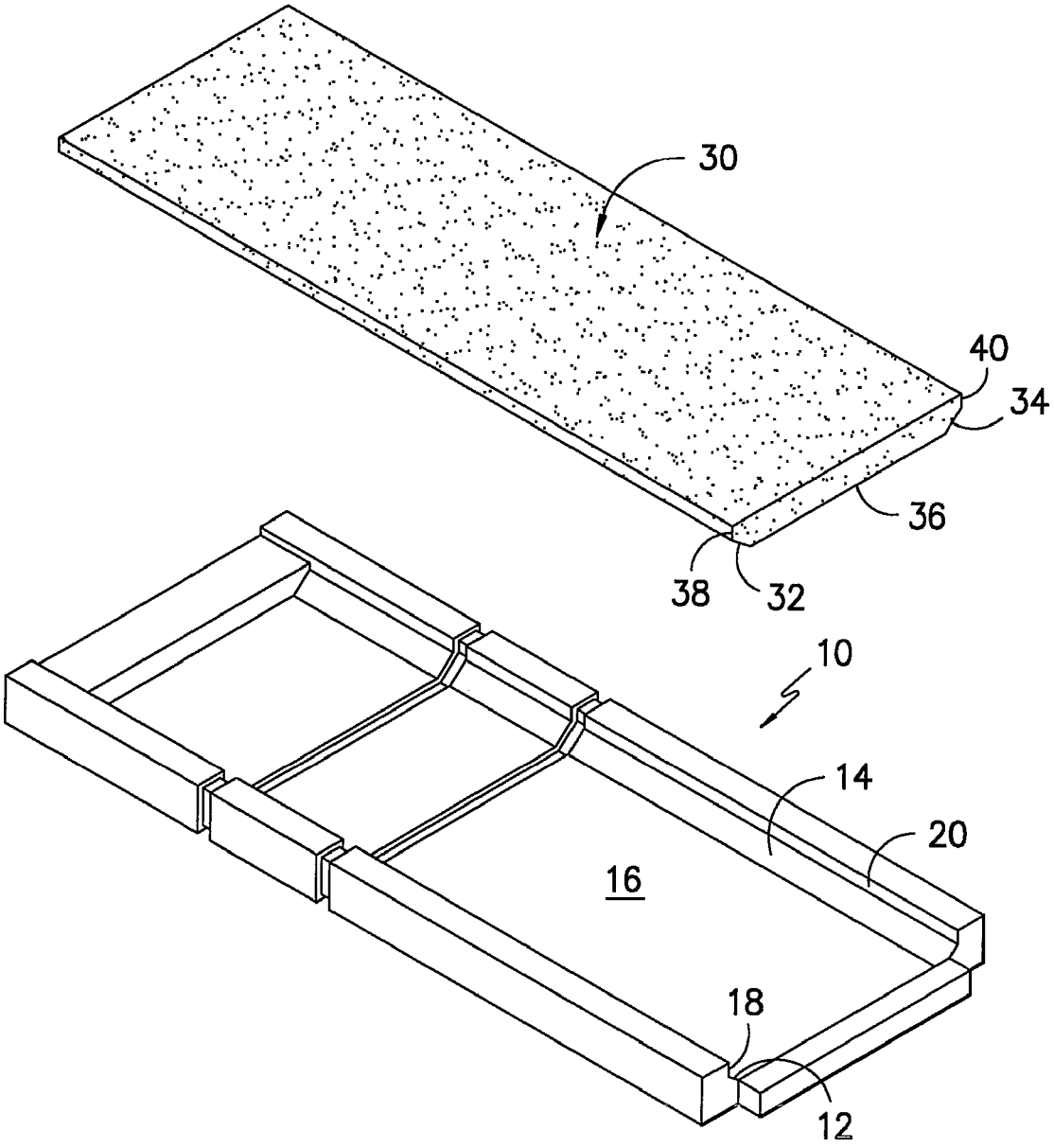
*FIG. —1—*
PRIOR ART

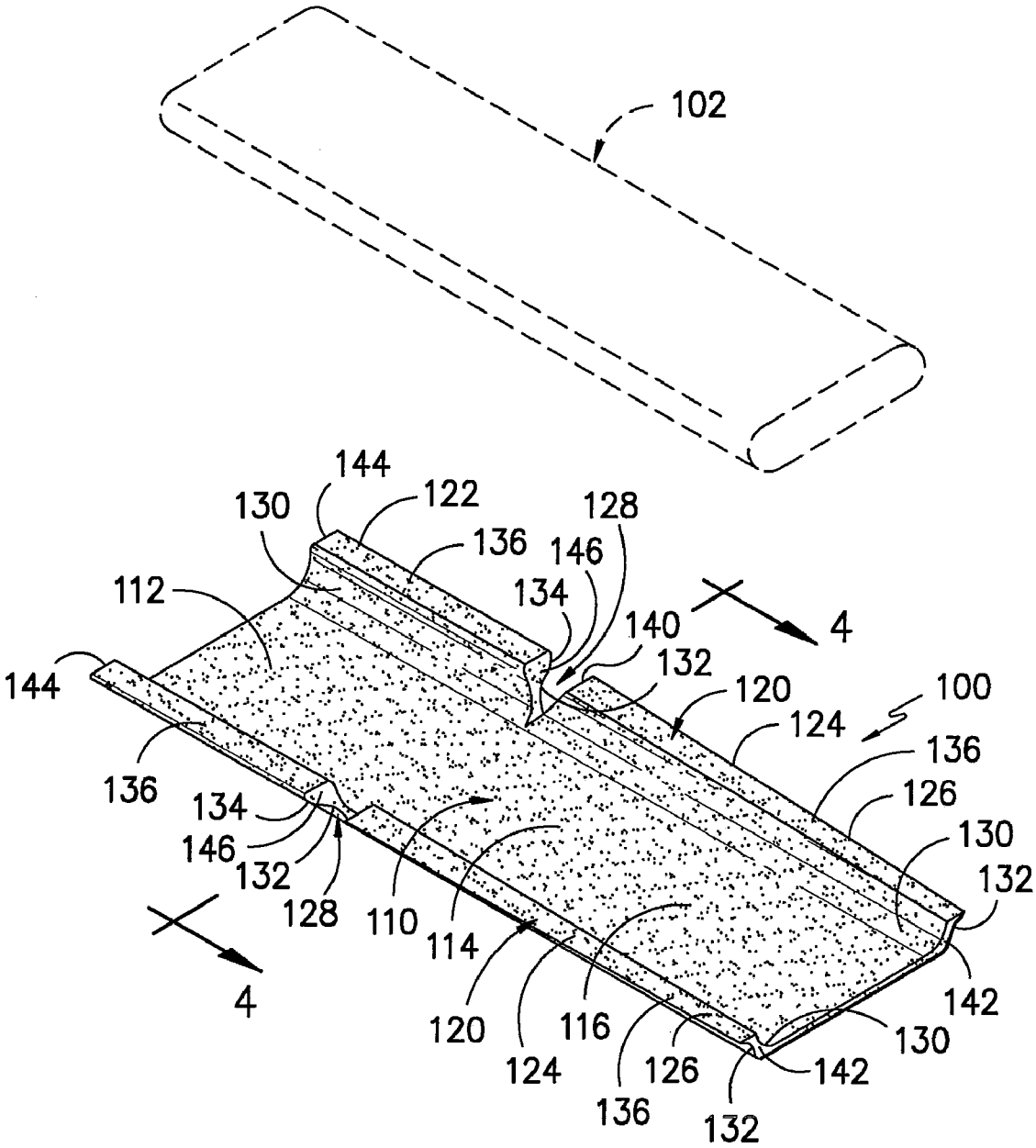
FIG. –2–

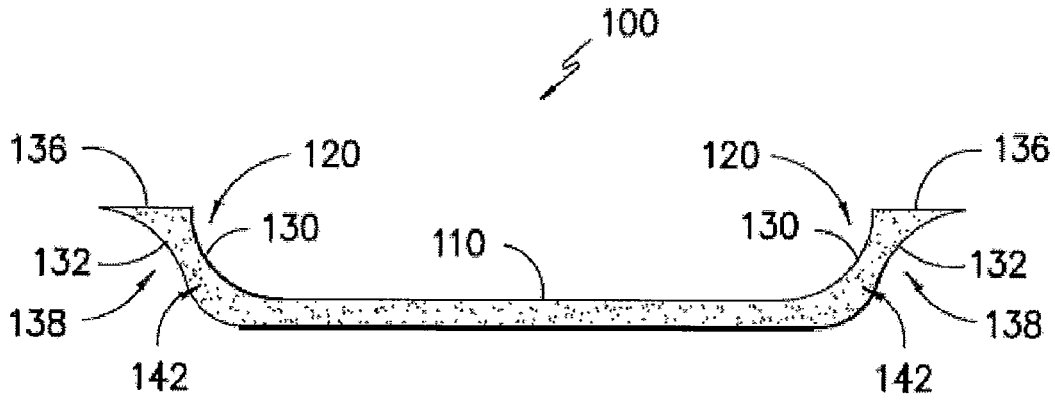
FIG. –3–
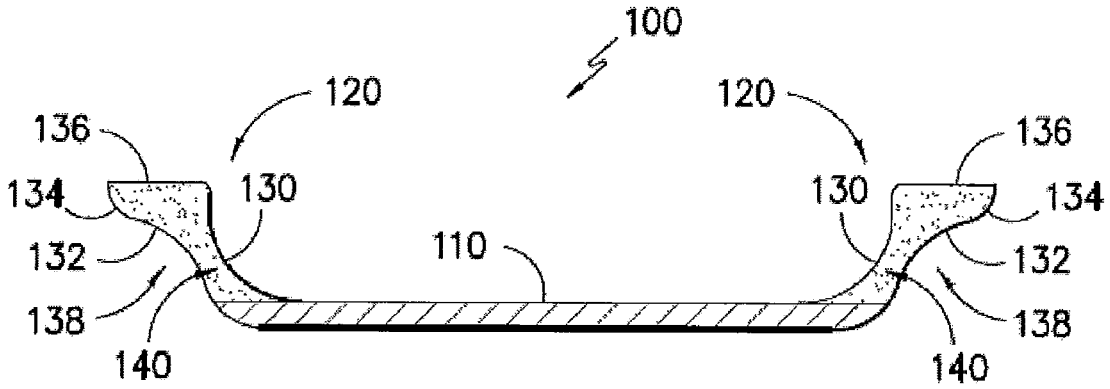
FIG. –4–

BED INSERT

PRIORITY CLAIM

This application claims the benefit of previously filed U.S. Provisional Patent Application entitled "BED INSERT WITH SAFETY FEATURE," assigned U.S. Ser. No. 61/378,507, filed Aug. 31, 2010, and which is incorporated herein by reference for all purposes.

FIELD OF THE INVENTION

The present subject matter relates generally to beds, and more specifically to inserts and related methodologies for use in beds in conjunction with mattresses and bed frames, especially for the patient-care environment.

BACKGROUND OF THE INVENTION

The design, construction, and use of mattresses and bed frames has been known and practiced for many years. In particular, mattresses and bed frames have been developed with various features for specific uses and in specific fields, such as in health care-related fields. For example, many known beds for hospitals and nursing homes include mattresses and bed frames with various features for adjusting the beds and for contributing to the safety of the patients utilizing the beds.

Examples of mattresses with various adjustable and safety-related features are disclosed in, for example, Kluft (U.S. Pat. No. 6,223,370) (disclosing a mattress having an anti-roll off feature), Kosumsuppamala et al. (U.S. Pat. No. 6,430,763) (disclosing a side bolster system for a mattress), Tarquinio (U.S. Pat. No. 6,601,253) (disclosing a multilayer foam mattress with side supports), and Gilchrest, Jr. et al. (U.S. Pat. Appl. Pub. No. 2006/0282955) (disclosing a bolster system and method).

Further examples of beds, mattresses, and bed frames are disclosed in Wilkinson et al. (U.S. Pat. No. 5,649,331) (disclosing a self-adjusting pressure relief support system and methodology), Wilkinson et al. (U.S. Pat. No. 5,652,985) (disclosing a self-adjusting pressure relief support system and methodology), Weismiller et al. (U.S. Pat. No. 5,682,631) (disclosing a bed having a reduced-shear pivot and step deck combination), Kramer et al. (U.S. Pat. No. 5,692,256) (disclosing a mattress for a hospital bed), Weismiller et al. (U.S. Pat. No. 5,745,937) (disclosing support surfaces for a bed), Maier et al. (U.S. Pat. No. 5,797,155) (disclosing a wheelchair cushion with protectively encased self-adjusting reservoir means), Wilkinson et al. (U.S. Pat. No. 6,036,271) (disclosing a self-adjusting pressure relief support system and methodology), Maier et al. (U.S. Pat. No. 6,223,369) (disclosing patient support surfaces), and Ellis et al. (U.S. Pat. No. 6,499,167) (disclosing a mattress section support).

Still further examples of mattress-related publications include U.S. Pat. No. 4,639,952; U.S. Pat. No. 4,754,509; U.S. Pat. No. 4,783,864; U.S. Pat. No. 5,010,611; U.S. Pat. No. 5,107,558; U.S. Pat. No. 5,822,817; U.S. Pat. No. 5,987,666; U.S. Pat. No. 6,182,310; U.S. Pat. No. 6,848,130; U.S. Pat. No. 7,017,208; U.S. Pat. No. 7,296,312; U.S. Pat. No. 7,360,265; U.S. Pat. No. 7,480,953; U.S. Pat. No. 7,520,006; U.S. Pat. No. 7,617,555; U.S. Pat. Appl. Pub. No. 2006/0282955; U.S. Pat. Appl. Pub. No. 2009/0188048; and Mevissen Published EPO Application Publication No. 0 558 108 A2.

The subject matter of each of the herein-referenced published patent-related documents is fully incorporated herein by reference, for all purposes.

Many such known bed frames and mattresses are designed having characteristic cross-sectional profiles. As shown in FIG. 1, for example, one known bed frame generally 10 includes an upper support area having angled side surfaces 12 and 14. Such angled side surfaces extend between a base surface 16 and generally upright sidewalls 18 and 20.

Mattresses designed for use with prior art bed frames such as the bed frame 10 shown in FIG. 1 generally must include side surfaces and cross-sectional profiles that mirror (i.e., match or mate with) the side surfaces and cross-sectional profiles of the bed frames. For example, as shown in FIG. 1, a corresponding prior art mattress 30 for use with bed frame 10 generally includes angled side surfaces 32 and 34 extending between a base surface 36 and corresponding generally upright sidewalls 38 and 40. Thus, various other types of mattresses, such as standard mattresses (such as with generally rectangular or oval cross-sectional profiles and without angled side surfaces) may not properly fit bed frames such as bed frame 10. Further, many prior art mattresses, including mattress 30 as well as various standard mattresses, generally do not include safety features intended for preventing or reducing the incidence of users from rolling off of the mattresses and falling from their beds. FIG. 1 is intended as representative only. The present subject matter herein disclosed is more generally applicable to different types of bed frames, having various cross-sectional profiles.

Thus, an insert for a bed frame having a cross-sectional profile that adapts such bed frame for use with a mattress having a different cross-sectional profile would be desired in the art. Further, such an insert that also includes improved safety features intended to prevent or reduce the incidence of users from falling from their beds would be advantageous.

SUMMARY OF THE INVENTION

Aspects and advantages of the present subject matter will be set forth in part in the following description, or may be apparent from the description, or may be learned through practice of the present subject matter.

In view of the recognized features encountered in the prior art and addressed by the present subject matter, improved apparatus and methodology are presently disclosed for beds and bed assemblies. It is a general object of the present disclosure to provide an insert for use with a mattress and a bed frame in a bed assembly. It is a more specific object of the present disclosure to provide an insert that adapts a bed frame having a particular cross-sectional profile for use with a mattress having a different cross-sectional profile. Further, such insert may include safety features intended to prevent or reduce the incidence of users from falling from the associated bed.

A present exemplary insert may include a base extending between opposing sidewalls. The base and sidewalls may each include respective head, neck, and shoulder ("upper") portion, a torso portion, and a heel portion. Each of the sidewalls may further include various surfaces. The surfaces of each sidewall may be contoured to allow the insert to be disposed in a bed frame such that the insert can accommodate a mattress therein. For example, inner surfaces of the sidewalls may be configured to accommodate a mattress thereon, and may thus be contoured to match the contours of the mattress. Outer surfaces of the sidewalls may be configured such that the insert may be disposed in a bed frame, and may further be configured to provide the insert with a safety feature.

For example, in exemplary embodiments, the outer surfaces of the insert may be curved such that, when the insert is disposed in a bed frame, an intentional gap is defined between the insert and the bed frame. Such gap may prevent or reduce the likelihood of a user of the insert falling from the side of an associated mattress disposed thereon. For example, when the weight of the user is applied to one of the sidewalls, such as when the user is rolling to the side of the mattress, the sidewall may collapse and deform against the bed frame, reducing or eliminating the gap. In accordance with present subject matter, construction of the sidewall (such that an intentional gap is initially defined between the sidewall and the bed frame) preferably when the sidewall collapses, tends to cause an upper surface of the sidewall to tilt inwardly. Such desired functionality causes an associated user to be guided towards the center of the mattress and away from the side of the mattress, thus constituting a safety feature.

Exemplary embodiments of an insert of the present disclosure may further include various tapered portions to provide optimal positioning of a user on a mattress disposed on the insert in a bed frame.

One present exemplary embodiment relates to an insert for a bed to facilitate use of a mattress having one cross-sectional profile with a bed frame having a different cross-sectional profile. Such an exemplary present insert preferably comprises a base with respective sidewalls extending from respective lateral areas of such base. Further preferably, such respective sidewalls have respective inner surfaces adapted to receive an associated mattress thereon, and respective outer surfaces adapted for support of such insert on an associated bed frame, with such inner surfaces preferably having different curvatures than those of such outer surfaces, so as allow use of such associated mattress in conjunction with use of such associated bed frame without requiring a mattress specially adapted to fit such associated bed frame.

In certain of such exemplary embodiments, such insert may be formed of resilient materials; and such outer surfaces may comprise at least a pair of two respective outer surfaces each, having different curvatures from one another so as to form an unloaded intentional gap between at least a portion of one of the respective outer surfaces and a bed frame received thereunder. With such an arrangement, loading of the weight of a user on one of such respective sidewalls of such insert causes such at least a portion of one of the respective outer surfaces to collapsibly deform to the bed frame, so that a user received on a mattress received on such insert is guided away from an associated edge of such mattress.

In other present exemplary arrangements, such insert may be comprised of foam.

In other present alternatives, such base and sidewalls each may include respectively a heel portion, a torso portion, and an upper portion for supporting the head, neck, and shoulders of a user. In particular of such variations, respective of such portions may be selectively tapered to provide optimal positioning of a user received on an associated mattress disposed on such insert in an associated bed frame.

In other present alternatives, such respective sidewalls may form respective gatching notches therein to facilitate bending of such insert during gatching of an associated bed frame; and such gatching notches may be formed in such sidewalls so as to at least partially define and distinguish such sidewall upper portions from such torso portions thereof.

Other present exemplary embodiments relate to a patient support system, preferably comprising associated bed frame, mattress, and resilient insert features. Such bed frame preferably includes an upper support area having angled respective side surfaces extending between a base surface and respective generally upright sidewalls. Such associated mattress preferably has respective side edges each having a predetermined curvature. Such associated resilient insert preferably has respective insert sidewalls extending from a base thereof, such respective insert sidewalls having respective inner surfaces with a predetermined mating curvature adapted to match such predetermined curvature edges of such mattress with such mattress received on such insert, and has respective outer surfaces of predetermined curvature so as to form an unloaded intentional gap between at least a portion of such respective outer surfaces and such bed frame with such insert received on such bed frame. With such an arrangement, loading of the weight of a patient on one of such respective insert sidewalls preferably causes such insert sidewall to collapsibly deform towards such side surfaces and sidewalls of such bed frame, so that a patient received on such mattress received on such insert is guided away from falling off a corresponding side edge of such mattress.

In variations of the foregoing patient support system, such resilient insert may be integrally formed from foam material.

In other present alternatives of the foregoing, different parts of such resilient insert may be formed by respective different foam materials having respective different support characteristics.

In yet other variations, such predetermined curvature of such mattress edges may be generally convexly-curved; and such insert sidewall inner surfaces may be generally concavely-curved.

Still further, such insert respective outer surfaces may include for each insert sidewall at least a pair of predetermined curvatures differing from one another in such pair. In other such variations, such predetermined curvatures may be predetermined for mating with side surfaces of such bed frame for support thereon with such unloaded intentional gap. In yet others, one of such pair of predetermined curvatures may comprise a convex surface while the other of such pair may comprise a concave surface adjacent such unloaded intentional gap.

In other present variations of the foregoing patient support system, such respective sidewalls may form respective gatching notches therein to facilitate bending of such insert during gatching of such bed frame. In alternatives thereof, such insert base and insert sidewalls each may include respectively a heel portion, a torso portion, and an upper portion for supporting the head, neck, and shoulders of a patient; and such gatching notches may be formed in such insert sidewalls so as to at least partially define and distinguish such insert sidewall upper portions from such torso portions thereof. Per further variations, such insert sidewalls may include upper surfaces between such inner and outer surfaces thereof, and selected of such insert sidewall surfaces may be tapered throughout at least a portion of the length thereof. Yet further, such tapering may be provided such that adjacent such heel portion such insert upper surfaces are narrowed and such insert outer surfaces are eliminated so that such heel portion may be disposed relatively lower than the remainder of such insert with respect to a bed frame, to allow a patient's heels to be lower than the rest of the patient's body when the patient is received on such mattress on such insert.

It is to be understood by those of ordinary skill in the art from the complete disclosure herein that the present subject matter equally pertains to both apparatus and related and/or corresponding methodology. One present exemplary embodiment thereof relates to a method of using an insert for a bed to facilitate use of a mattress having one cross-sectional profile with a bed frame having a different cross-sectional profile. Such a method preferably comprises providing an insert formed of resilient materials having a base; and respective sidewalls extending from respective lateral areas of such base, such respective sidewalls having respective inner surfaces adapted to receive an associated mattress thereon, and respective outer surfaces adapted for support of such insert on an associated bed frame, with such inner surfaces have different curvatures than those of such outer surfaces; providing an associated bed frame and supporting such insert thereon; and providing an associated mattress and supporting such mattress on such insert, so as allow use of such associated mattress in conjunction with use of such associated bed frame without requiring a mattress specially adapted to fit such associated bed frame.

In alternatives of such methodology, such method may further include providing such insert sidewall outer surfaces with at least a pair of two respective outer surfaces each, with curvature such that when such insert is disposed on the associated bed frame in an unloaded condition, an intentional gap is defined between the insert and the bed frame, and when the weight of a user is applied to a respective such sidewall, such respective sidewall collapses towards the bed frame to reduce or eliminate such gap and the upper surface of such sidewall tilts inwardly. With such methodology, the user is preferably guided towards the center of the mattress to reduce the likelihood of such user falling from the associated mattress.

In another present variation, such insert resilient materials may be comprised of foam; and such base and sidewalls each may include respectively a heel portion, a torso portion, and an upper portion for supporting the head, neck, and shoulders of a user.

Per still further variations, respective of such portions may be selectively tapered to provide optimal positioning of a user received on an associated mattress disposed on such insert in an associated bed frame; such respective sidewalls may form respective gatching notches therein to facilitate bending of such insert during gatching of an associated bed frame; and such gatching notches may be formed in such sidewalls so as to at least partially define and distinguish such sidewall upper portions from such torso portions thereof.

Additional objects and advantages of the present subject matter are set forth in, or will be apparent to, those of ordinary skill in the art from the detailed description herein. Also, it should be further appreciated that modifications and variations to the specifically illustrated, referred and discussed features, elements, and steps hereof may be practiced in various embodiments and uses of the present subject matter without departing from the spirit and scope of the subject matter. Variations may include, but are not limited to, substitution of equivalent means, features, or steps for those illustrated, referenced, or discussed, and the functional, operational, or positional reversal of various parts, features, steps, or the like.

Still further, it is to be understood that different embodiments, as well as different presently preferred embodiments, of the present subject matter may include various combinations or configurations of presently disclosed features, steps, or elements, or their equivalents including combinations of features, parts, or steps or configurations thereof not expressly shown in the figures or stated in the detailed description of such figures. Additional embodiments of the present subject matter, not necessarily expressed in the summarized section, may include and incorporate various combinations of aspects of features, components, or steps referenced in the summarized objects above, and/or other features, components, or steps as otherwise discussed in this application. Those of ordinary skill in the art will better appreciate the features and aspects of such embodiments, and others, upon review of the remainder of the specification. The accompanying drawings, which are incorporated in and constitute a part of this specification, illustrate embodiments of the present subject matter and, together with the description, serve to explain the principles of the present subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which:

FIG. 1 illustrates a generally top perspective, exploded view of a representative prior art bed frame and associated mattress;

FIG. 2 is a generally top perspective view of an exemplary embodiment of an insert in accordance with the present disclosure;

FIG. 3 is an end view of an exemplary embodiment of an insert in accordance with the present disclosure; and FIG. 4 is a cross-sectional view of exemplary embodiment of an insert in accordance with the present disclosure, taken along the sectional line 4-4 of present FIG. 2.

Repeat use of reference characters throughout the present specification and appended drawings is intended to represent same or analogous features, elements, or steps of the present subject matter.

DETAILED DESCRIPTION OF THE PREFERRED EMBODIMENTS

Reference is herein made in detail to exemplary embodiments of the present subject matter, one or more examples of which are illustrated in or represented by the drawings. Each example is provided by way of explanation of the present subject matter, not limitation of the present subject matter. In fact, it will be apparent to those skilled in the art that various modifications and variations can be made in and to the present subject matter without departing from the scope or spirit of the present subject matter. For instance, features illustrated or described as part of one embodiment may be used with another embodiment to yield a still further embodiment. Thus, it is intended that the present subject matter covers such modifications and variations as come within the scope of the disclosure and equivalents thereof.

An exemplary embodiment of an insert in accordance with the present disclosure is further described with reference to present FIGS. 2 through 4. FIG. 2 illustrates an exemplary such insert generally 100. In exemplary embodiments, such insert 100 may be preferably formed from foam. However, it should be understood that the present disclosure is not intended as being limited to foam inserts. Rather, the insert 100 of the present disclosure may be formed from any suitable material with, for example, any suitable support and/or deformation properties.

Insert 100 of the present disclosure may be utilized in a bed frame to adapt the bed frame for use with a mattress not otherwise particularly adapted as originally provided for use with such bed frame. For example, an exemplary present insert 100 may be utilized with an exemplary prior art bed frame 10 (represented in present FIG. 1). Such insert 100 advantageously allows for a mattress having a cross-sectional profile that is different than the cross-sectional profile of the bed frame to be nonetheless utilized with the bed frame. For example, one embodiment of a standard mattress 102 (such as with a generally oval cross-section) is represented in present FIG. 2, illustrated in exploded position relative to insert 100. It will be understood by those of ordinary skill in the art from the disclosure herewith that present insert 100 may, for example, be placed in or otherwise associated with prior art bed frame 10 to adapt such prior art bed frame 10 for use with standard mattress 102. With such advantageous use of present insert 100, any required usage of prior art mattress 30 is obviated.

Insert 100 may preferably include a base 110. The base 110 may include various portions configured to support the various portions of a user's body. For example, the base 110 may include respective head, neck, and shoulder ("upper") portion generally 112, a torso portion 114, and a heel portion generally 116. The base 110 may extend between opposing sidewalls 120. The sidewalls 120 may each include various portions associated with the various portions of the user's body. For example, the sidewalls 120 may each include a head, neck and shoulder ("upper") portion 122, a torso portion 124, and a heel portion 126. In general, the upper portions 122 may be those portions of the sidewalls 120 that are connected to the upper portion 112 of the base 110, while the torso portions 124 and heel portions 126 may be those portions of the sidewalls 120 that are connected to the torso portion 114 and the heel portion 116, respectively, of the base 110.

The base 110 and sidewalls 120 may include more or less portions, as desired or as required for a specific user or embodiment. Further, the various portions of the base 110 and sidewalls 120 may be formed from the same material, such as from the same foam, or may be formed from different materials, such as from different foams with varying hardnesses, and other differing characteristics.

In various present embodiments, each of the sidewalls 120 may define or form a gatching notch 128. Such gatching notches 128 may generally be cut-away areas in or portions of the sidewalls 120. For example, gatching notches 128 may be generally V-shaped, or may have any other suitable shapes. The gatching notches 128 may allow the sidewalls 120 to bend and deform due to gatching of the bed frame with which insert 100 is used, such as prior art bed frame 10 or some other.

Gatching notches 128 may further be located on the sidewalls 120 so as to at least partially define various of the portions of the sidewalls 120 and the base 110. For example, as shown in FIGS. 2 through 4, the gatching notches 128 define and distinguish the upper portions 122 of the sidewalls 120 from the torso portions 124 of the sidewalls. Further, as illustrated, the gatching notches 128 also define and distinguish the upper portion 112 of the base 110 from the torso portion 114 of such base 110.

Each of the sidewalls 120 may further include various surfaces. The surfaces of each sidewall 120 may be contoured in accordance with the present subject matter to facilitate insert 100 being disposed in a bed frame such that the insert 100 can accommodate a mattress therein. For example, various of the surfaces of each sidewall 120 may be curved to accommodate a mattress therein. Further, the curved surfaces of the sidewalls 120 may provide safety features for the insert 100. Such safety features may prevent or reduce the risk of a user falling from the side of a mattress disposed on the insert 100.

For example, each of the sidewalls 120 may preferably include an inner surface 130 in accordance with present subject matter. Such inner surface 130 may be contoured to accommodate a mattress thereon. For example, the inner surface 130 may have a generally concave curve, as represented in exemplary present FIGS. 2 through 4, and thus may be able to accommodate the convexly-curved outer surface of a standard mattress with an oval cross-sectional profile, such as representative mattress 102. Alternatively, however, such inner surface 130 may have a generally convex curve, a generally planar surface, or may include any other suitable contour, all in accordance with the present subject matter, to facilitate use of various mattresses, respectively. Further, the inner surface 130 may have any combination of contours thereof, as desired to accommodate a mattress of particular cross-section thereon or therewith.

Additionally, each of the sidewalls 120 may include a first outer surface 132, a second outer surface 134, and an upper surface 136. In general, the first outer surface 132 and second outer surface 134 may be portions of the outer surface of a sidewall 120 that have varying orientations and/or curvatures. The upper surface 136 may generally extend between the outer surface and the inner surface of the sidewall 120, and may be generally planar or have any suitable curvature.

The outer surfaces 132 and 134 preferably may be contoured for intended association with a particular bed frame, such as prior art bed frame 10. For example, in one embodiment, the outer surface 132 of each sidewall 120 may have a desired surface disposed relative to (for example, matching or mating) that of one of the respective side surfaces 12 and 14 of the bed frame 10, and the outer surface 134 of each sidewall 120 may be a planar surface disposed in an upright orientation generally equivalent to (i.e., matching or mating) that of one of the respective upright sidewalls 18 and 20 of the prior art bed frame 10. Thus, the present insert 100 may fit within the representative prior art bed frame 10 with the various outer surfaces generally adjacent to and/or in contact with the various surfaces of such bed frame 10. In some presently preferred exemplary embodiments, no connection or securement other than frictional conditions between surfaces is used between the subject insert and a given bed frame. In other present exemplary embodiments, a zippered closure or hook and loop-type closure may be used to supplement securement between the subject insert and a given bed frame.

In alternative exemplary embodiments, the outer surface 132 and/or the outer surface 134 of each of the sidewalls 120 may be appropriately curved. For example, the outer surface 132 may have a generally concave curve, while the outer surface 134 may have a generally convex curve.

Further, when the insert 100 is disposed in a bed frame such as bed frame 10, the insert 100 may preferably define an intentional gap 138 between the generally concave outer surface 132 of each of the sidewalls 120 and the angled side surfaces 12 and 14 and/or upright sidewalls 18 and 20 of the bed frame 10. Such gaps 138 between each of the sidewalls 120 and a bed frame such as, for example, bed frame 10, may provide the insert 100 with a safety feature when disposed in the bed frame, by preventing or reducing the risk of a user falling from the side of a mattress disposed on the insert 100 and bed frame. For example, the gaps 138 may allow the sidewalls 120 to collapse against the bed frame when a user sits or lies on a mattress disposed on the insert 100 and bed frame. The weight of the user, when applied to one or both of the sidewalls 120, may cause the sidewalls 120 to collapse, such that the outer surfaces 132 deform generally against the bed frame and reduce or close the gaps 138.

After the outer surface 132 of a sidewall 120 collapses, the sidewall 120 may thus be adjacent to and/or in contact with one of the angled side surfaces 12 and 14 and/or one of the upright sidewalls 18 and 20. Such collapse preferably is intended to cause the upper surface 136 of the sidewall 120 to tilt inwardly towards the base 110 of the insert 100, guiding the user away from the edge of the mattress and insert 100, and towards the center of the mattress and insert 100, thus preventing or reducing the risk of the user falling from the side of the mattress.

As shown in FIGS. 2 through 4, the torso portions 124 and heel portions 126 of each of the sidewalls 120 may extend between a first end 140 and a second end 142 of insert 100. The first end 140 may generally be at least partially defined by the gatching notch 128, while the second end 142 may generally be the bottom end of the sidewall 120.

In some embodiments, various of the surfaces 130, 132, 134, 136 of the torso portions 124 and heel portions 126 of the sidewalls 120 may be tapered throughout the lengths of the sidewalls 120 or portions thereof between the first end 140 and the second end 142. For example, outer surface 134 may taper between the first end 140 and the second end 142. Further, the taper may be at a rate such that the outer surface 134 is absent from the second end 142, as illustrated in representative present FIG. 3. Additionally, the width of upper surface 136 may taper between the first end 140 and the second end 142 such that, for example, the width of upper surface 136 at the second end 142 is smaller than the width at the first end 140. Beneficially, the narrow width of upper surface 136 and the elimination of outer surface 134 at the second end 142 may allow the heel portions 116 and 126 of the insert 100 to be disposed relatively lower than the remainder of the insert 100 with respect to a bed frame (such as bed frame 10), thereby advantageously allowing a user's heels to be lower than the rest of the user's body when the user is sitting or laying on a mattress disposed on the insert 100. It should be understood, however, that the present disclosure is not limited to tapers in the directions and at the rates (i.e., angles) disclosed above. Rather, any variation of any particular taper of any of the surfaces of the insert 100 or any portions thereof is understood to be within the scope and spirit of the present disclosure.

The upper portions 122 of each of the sidewalls 120 may additionally extend between a first end 144 and a second end 146. The first end 144 may generally be the top end of the insert 100, while the second end 146 may generally be at least partially defined by the gatching notch 128. The surfaces 130, 132, 134, 136 of the upper portions 122 of the sidewalls 120 may be generally constant throughout the length of the upper portions 122 between the first ends 144 and second ends 146 or, alternatively, various of the surfaces may taper throughout the length or portions thereof between the first ends 144 and second ends 146.

As discussed, the insert 100 may beneficially be a separate component from any mattress used with the insert 100 and a bed frame, such as the bed frame 10. Thus, the sidewalls 120 of the insert 100 may, in some embodiments, beneficially collapse independent of the mattress. Further, the insert 100 and mattress may be formed of different materials. For example, the materials for the insert 100, such as for the sidewalls 120, may be chosen such that the collapse feature of the insert 100 is optimized, while the materials for the mattress may be chosen such that various mattress features are independently optimized.

The present written description uses examples to disclose the present subject matter, including the best mode, and also to enable any person skilled in the art to practice the present subject matter, including making and using any devices or systems and performing any incorporated and/or associated methods. While the present subject matter has been described in detail with respect to specific embodiments thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art.

What is claimed is:

1. An insert for a bed to facilitate use of a mattress having one cross-sectional profile with a bed frame having a different cross-sectional profile, comprising:

a base; and respective sidewalls extending from respective lateral areas of said base, said respective sidewalls having respective inner surfaces with a curvature adapted to receive an associated mattress thereon, and respective outer surfaces with a curvature adapted for support of said insert on an associated bed frame, wherein said inner surfaces have different curvatures than those of said outer surfaces, so as allow use of such associated mattress in conjunction with use of such associated bed frame without requiring a mattress specially adapted to fit such associated bed frame.

2. An insert as in claim 1, wherein:

said insert is formed of resilient materials; and said outer surfaces comprise at least a pair of two respective outer surfaces each, having different curvatures from one another so as to form an unloaded intentional gap between at least a portion of one of the respective outer surfaces and a bed frame received thereunder, so that loading of the weight of a user on one of said respective sidewalls of said insert causes such at least a portion of one of the respective outer surfaces to collapsibly deform to the bed frame, so that a user received on a mattress received on said insert is guided away from an associated edge of such mattress.

3. An insert as in claim 2, wherein said insert is comprised of foam.

4. An insert as in claim 1, wherein said base and sidewalls each include respectively a heel portion, a torso portion, and an upper portion for supporting the head, neck, and shoulders of a user.

5. An insert as in claim 4, wherein respective of said portions are selectively tapered to provide optimal positioning of a user received on an associated mattress disposed on said insert in an associated bed frame.

6. An insert as in claim 4, wherein:

said respective sidewalls form respective gatching notches therein to facilitate bending of said insert during gatching of an associated bed frame; and said gatching notches are formed in said sidewalls so as to at least partially define and distinguish said sidewall upper portions from said torso portions thereof.

7. A method of using an insert for a bed to facilitate use of a mattress having one cross-sectional profile with a bed frame having a different cross-sectional profile, comprising providing an insert formed of resilient materials having a base; and respective sidewalls extending from respective lateral areas of such base, such respective sidewalls having respective inner surfaces with a curvature adapted to receive an associated mattress thereon, and respective outer surfaces with a curvature adapted for support of such insert on an associated bed frame, with such inner surfaces having different curvatures than those of such outer surfaces;

providing an associated bed frame and supporting such insert thereon; and providing an associated mattress and supporting such mattress on such insert, so as allow use of such associated mattress in conjunction with use of such associated bed frame without requiring a mattress specially adapted to fit such associated bed frame.

8. A method as in claim 7, providing such insert sidewall outer surfaces with at least a pair of two respective outer surfaces each, with curvature such that when such insert is disposed on the associated bed frame in an unloaded condition, an intentional gap is defined between the insert and the bed frame, and when the weight of a user is applied to a respective such sidewall, such respective sidewall collapses towards the bed frame to reduce or eliminate such gap and the upper surface of such sidewall tilts inwardly, so that the user is guided towards the center of the mattress to reduce the likelihood of such user falling from the associated mattress.

9. A method as in claim 7, wherein:

said insert resilient materials are comprised of foam; and such base and sidewalls each include respectively a heel portion, a torso portion, and an upper portion for supporting the head, neck, and shoulders of a user.

10. A method as in claim 9, wherein respective of said portions are selectively tapered to provide optimal positioning of a user received on an associated mattress disposed on said insert in an associated bed frame;

said respective sidewalls form respective gatching notches therein to facilitate bending of said insert during gatching of an associated bed frame; and said gatching notches are formed in said sidewalls so as to at least partially define and distinguish said sidewall upper portions from said torso portions thereof.

11. A patient support system, comprising:

a bed frame having an upper support area having angled respective side surfaces extending between a base surface and respective generally upright sidewalls;

a mattress having respective side edges each having a predetermined curvature; and a resilient insert having respective insert sidewalls extending from a base thereof, said respective insert sidewalls having respective inner surfaces with a predetermined mating curvature adapted to match said predetermined curvature edges of said mattress with said mattress received on said insert, and having respective outer surfaces of predetermined curvature so as to form an unloaded intentional gap between at least a portion of said respective outer surfaces and said bed frame with said insert received on said bed frame, so that loading of the weight of a patient on one of said respective insert sidewalls causes such insert sidewall to collapsibly deform towards said side surfaces and sidewalls of said bed frame, so that a patient received on said mattress received on said insert is guided away from falling off a corresponding side edge of said mattress.

12. A patient support system as in claim 11, wherein said resilient insert is integrally formed from foam material.

13. A patient support system as in claim 11, wherein different parts of said resilient insert are formed by respective different foam materials having respective different support characteristics.

14. A patient support systems as in claim 11, wherein:

said predetermined curvature of said mattress edges is generally convexly-curved; and said insert sidewall inner surfaces are generally concavely-curved.

15. A patient support system as in claim 11, wherein said insert respective outer surfaces include for each insert sidewall at least a pair of predetermined curvatures differing from one another in such pair.

16. A patient support system as in claim 15, wherein said predetermined curvatures are predetermined for mating with side surfaces of said bed frame for support thereon with said unloaded intentional gap, so that no securement connection is required between said insert and said bed frame other than said mating curvatures and side surfaces.

17. A patient support system as in claim 16, wherein one of said pair of predetermined curvatures comprises a convex surface while the other of said pair comprises a concave surface adjacent said unloaded intentional gap.

18. A patient support system as in claim 11, wherein said respective sidewalls form respective gatching notches therein to facilitate bending of said insert during gatching of said bed frame.

19. A patient support system as in claim 18, wherein:

said insert base and insert sidewalls each include respectively a heel portion, a torso portion, and an upper portion for supporting the head, neck, and shoulders of a patient; and said gatching notches are formed in said insert sidewalls so as to at least partially define and distinguish said insert sidewall upper portions from said torso portions thereof.

20. A patient support system as in claim 19, wherein said insert sidewalls include upper surfaces between said inner and outer surfaces thereof, and wherein selected of said insert sidewall surfaces are tapered throughout at least a portion of the length thereof.

21. A patient support system as in claim 20, wherein said tapering is provided such that adjacent said heel portion said insert upper surfaces are narrowed and said insert outer surfaces are eliminated so that said heel portion may be disposed relatively lower than the remainder of said insert with respect to a bed frame, to allow a patient's heels to be lower than the rest of the patient's body when the patient is received on said mattress on said insert.

* * * * *